US009102575B2

(12) United States Patent
Kim

(10) Patent No.: US 9,102,575 B2
(45) Date of Patent: Aug. 11, 2015

(54) PROPELLANT DISPOSAL DEVICE FOR A PROPULSION SYSTEM

(71) Applicant: JJPROTECH CO., LTD, Gyeongsangnam-do (KR)

(72) Inventor: Ji-Tae Kim, Gyeongsangnam-do (KR)

(73) Assignee: JJPROTECH CO., LTD. (KR)

( * ) Notice: Subject to any disclaimer, the term of this patent is extended or adjusted under 35 U.S.C. 154(b) by 256 days.

(21) Appl. No.: 13/629,247

(22) Filed: Sep. 27, 2012

(65) Prior Publication Data

US 2014/0082908 A1 Mar. 27, 2014

Related U.S. Application Data

(63) Continuation of application No. PCT/KR2011/002139, filed on Mar. 29, 2011.

(30) Foreign Application Priority Data

Apr. 2, 2010 (KR) ..... 10-2010-0030367

(51) Int. Cl.

| | |
|---|---|
| ***B25B 27/14*** | (2006.01) |
| ***C06C 5/06*** | (2006.01) |
| ***B24C 5/04*** | (2006.01) |
| ***C06B 21/00*** | (2006.01) |
| *B23P 17/04* | (2006.01) |

(52) U.S. Cl.

CPC ..... *C06B 21/00* (2013.01); *Y10T 29/53961* (2015.01)

(58) Field of Classification Search

USPC ..... 29/281.1; 541/102, 89; 102/275.11, 430

See application file for complete search history.

(56) References Cited

U.S. PATENT DOCUMENTS

| | | | | | |
|---|---|---|---|---|---|
| 3,047,986 | A | * | 8/1962 | McKulla, Jr. | 451/89 |
| 3,100,724 | A | * | 8/1963 | Rocheville | 118/308 |
| 4,449,332 | A | * | 5/1984 | Griffiths | 451/102 |
| 4,754,704 | A | * | 7/1988 | Lubbers | 102/275.11 |
| 4,758,387 | A | * | 7/1988 | Sayles | 264/3.1 |
| 5,062,366 | A | * | 11/1991 | Candland et al. | 102/430 |
| 5,211,777 | A | * | 5/1993 | Nahlovsky et al. | 149/109.6 |
| 5,463,169 | A | * | 10/1995 | Hebisch et al. | 588/316 |
| 5,574,244 | A | * | 11/1996 | Powell et al. | 89/7 |
| 5,615,983 | A | * | 4/1997 | Hoekstra | 409/132 |
| 5,871,068 | A | * | 2/1999 | Selby | 184/1.5 |
| 6,543,327 | B1 | * | 4/2003 | Mueller, Sr. | 86/50 |
| 7,477,966 | B1 | * | 1/2009 | Mango | 701/13 |

(Continued)

FOREIGN PATENT DOCUMENTS

| | | | |
|---|---|---|---|
| JP | 2002-039699 | A | 2/2002 |
| JP | 2003-314998 | A | 11/2003 |
| KR | 10-0388431 | B1 | 6/2003 |

OTHER PUBLICATIONS

PCT Search Report (PCT/KR2011/002139).

*Primary Examiner* — Lee D Wilson
*Assistant Examiner* — Alvin Grant
(74) *Attorney, Agent, or Firm* — Park & Associates IP Law, P.C.

(57) ABSTRACT

A propellant disposal device for a propulsion system, wherein disposal of the propulsion system is performed through an automated process, and the propellant charged within the propulsion system is collected simultaneously through the automated process, to thereby enable the propulsion system to be re-utilized through the disposal processes.

11 Claims, 15 Drawing Sheets

(56) References Cited

U.S. PATENT DOCUMENTS

| | | | | |
|---|---|---|---|---|
| 8,596,039 | B2 * | 12/2013 | Goislot | 60/258 |
| 2002/0029829 | A1 * | 3/2002 | Jones et al. | 149/88 |
| 2004/0089450 | A1 * | 5/2004 | Slade et al. | 166/298 |
| 2004/0119795 | A1 * | 6/2004 | Noolandi et al. | 347/85 |
| 2007/0000518 | A1 * | 1/2007 | Korolik et al. | 134/21 |

* cited by examiner

PROPELLANT DISPOSAL DEVICE FOR A PROPULSION SYSTEM

REFERENCE TO RELATED APPLICATIONS

This is a continuation of pending International Patent Application PCT/KR2011/002139 filed on Mar. 29, 2011, which designates the United States and claims priority of Korean Patent Application No 10-2010-0030367 filed on Apr. 2, 2010, the entire contents of which are incorporated herein by reference.

FIELD OF THE INVENTION

The present invention relates to a disposal device, and more particularly, to a propellant disposal device for a propulsion system which separates propellants from a solid propulsion system containing solid propellants therein, such as rockets or shells, to thereby reutilize the propulsion system.

BACKGROUND OF THE INVENTION

In general, a rocket bomb is divided into a propulsion system, a warhead and a fuse, and in this instance, the propulsion system has a combustion tube made of aluminum, and the combustion tube is charged with solid propellants of a mixed type consisting of various compounds. In this instance, the solid propellants are propelling charges of a solid type.

A disposal of the propulsion system of the rocket bomb is carried out through a discard process if the propulsion system becomes superannuated. That is, the propulsion system is discarded through the process of disassembling the propulsion system manually, extracting the solid propellants charged in the propulsion system, and incinerating the solid propellants.

However, the above-mentioned discard process has several problems in that it needs a safety structure because it always has problems of explosion of the solid propellants or emission of noxious gases, and in that it is very difficult to relieve bolts to separate and disassemble the propulsion system in the case that the bolts are worn out.

So, recently, Korean Patent No. 10-0531123 discloses a method of treating and emitting noxious gases generated after solid propellants are burnt out inside a propulsion system without the process of separating and disassembling the propulsion system, and various efforts for safe disposal of propellants have been made.

However, the prior arts have a problem in that the propulsion system is not reutilized due to combustion or incineration of the solid propellants, and particularly, the combustion tube of the propulsion system is made of expensive aluminum but is not reutilized due to combustion of the solid propellants.

SUMMARY OF THE INVENTION

Accordingly, the present invention has been made in an effort to solve the above-mentioned problems occurring in the prior arts, and it is an object of the present invention to provide a propellant disposal device for a propulsion system which can simultaneously carry out disposal of the propulsion system and collection of propellants charged within the propulsion system through an automated process to thereby enable the propulsion system to be reutilized through the disposal process.

To achieve the above objects, the present invention provides a propellant disposal device for a propulsion system including: a carry-in unit which provides a target propulsion system; a cutting unit which is arranged for the process subsequent to that of the carry-in unit, and which individually receives the propulsion systems that are on standby at the carry-in unit and cuts both ends of the received propulsion system; a propellant extraction unit which is arranged for the process subsequent to that of the cutting unit, and which moves into the cut ends of the propulsion system and extracts the propellants charged within the propulsion system; and delivery units arranged in between the said units to sequentially deliver the propulsion system to the corresponding process positions.

Moreover, the cutting unit includes: a first main frame forming the outward appearance of the cutting unit and having an upper wall and both side walls; a seating part disposed at the bottom inside the first main frame for seating the propulsion system received by the return unit; a pair of cutters elevatably mounted on the first main frame by an operation of an elevation cylinder and driven by a driving force of a motor for cutting to respectively cut both ends of the propulsion system seated on the seating part; and a movement prevention part disposed directly above the seating part which is located at an upper part inside the first main frame, the movement prevention part getting in contact with the upper surface of the propulsion system seated on the seating part to prevent movement of the propulsion system during cutting work.

Furthermore, the seating part includes: a pair of rotary shafts respectively mounted on front and rear sides of the bottom of the propulsion system and rotated by a driving force of a motor for rotation; and rotational rollers adapted for rotating in contact with the front and rear sides of the bottom of the propulsion system to thereby rotate the propulsion system.

Additionally, the movement prevention part is mounted in such a way as to be elevated by the elevation cylinder of the first main frame and comprises a contact roller disposed at an end of a lower portion thereof in such a way as to perform a rolling action in contact with the upper surface of the propulsion system.

In addition, the separation unit includes: a pair of grasping chucks respectively mounted on both side walls of the first main frame in a horizontally movable manner along a longitudinal direction of the propulsion system; and delivery clamps respectively elevatably mounted on both side walls of the first main frame in such a way as to be movable back and forth, to thereby grasp and deliver the cut ends of the propulsion system grasped by the grasping chucks.

Moreover, the propellant extraction unit includes: a second main frame forming the outward appearance of the propellant extraction unit and having an upper wall and both side walls; a seating base disposed at the bottom inside the second main frame and having seating recess formed on the upper surface thereof for seating the circumferential surface of the lower end of the propulsion system, whose both ends are cut, received by the return unit; a fixing clamp elevatably mounted on the second main frame for preventing rotation of the propulsion system while pressurizing the circumferential surface of the upper end of the propulsion system seated on the seating base; tool assemblies respectively located at both sides of the seating base and adapted to grasp propellants charged within the propulsion system while moving into the cut ends of the propulsion system seated on the seating base; a driving unit adapted for driving the tool assemblies; and a moving unit adapted for horizontally moving the driving unit.

Furthermore, each of the tool assemblies has a cutting tool formed in a conical shape whose diameter is gradually reduced toward an end thereof.

Additionally, the driving unit comprises a driving motor and a driving shaft joined with the tool assembly while being driven by the driving force of the driving motor, wherein the driving shaft is in an empty pipe form and the inside of the tool assembly is opened, so that cooling water is supplied to the inside of the driving shaft.

In addition, the return unit includes: a first return lever having an end located at the side of the carry-in unit where the propulsion system is provided and the other end located at the bottom of the side of the cutting unit where the propulsion system is seated, the first return lever being gradually downwardly inclined from one end toward the other end; a second return lever having an end located at the bottom of the side of the cutting unit where the propulsion system is seated and the other end located at the bottom of the side of the propellant extraction unit where the propulsion system is seated, the second return lever being gradually downwardly inclined from one end toward the other end; a third return lever having an end located at the bottom of the side of the propellant extraction unit where the propulsion system is seated and the other end located toward a delivery place of the propulsion system, the third return lever being gradually downwardly inclined from one end toward the other end; and elevation cylinders respectively and selectively elevating the return levers, wherein the return levers are arranged to intercross one another, so that they do not interfere with one another in operation.

Moreover, the propellant disposal device for the propulsion system according to the present invention further includes a propellant delivery unit that has an end located at the bottom of a portion of the propellant extraction unit where both ends of the propulsion system are located and that delivers the extracted propellants.

Furthermore, the propellant delivery unit includes: a conveyer formed at a portion of an area ranging from the end which receives the propellants to the other end which delivers the propellants, the conveyer being inclined gradually upwards; and a hopper disposed at the side of the conveyer where the propellants are extracted for containing the propellants therein.

The propellant disposal device for the propulsion system according to the present invention enables the propulsion system made of aluminum and the propellants to be reutilized because it can extract the propellants from the propulsion system.

Moreover, the propellant disposal device for the propulsion system according to the present invention can continuously and rapidly dispose of the propulsion systems in quantity to reduce a disposal period of time and carry out the disposal work in safety because it carries out the disposal of the propulsion systems through the automated process.

DETAILED DESCRIPTION OF THE INVENTION

Hereinafter, referring to FIGS. 1 to 15, a preferred embodiment of a propellant disposal device for the propulsion system according to the present invention will be described.

In the present invention, the propulsion system is, as an example, a propulsion system for a rocket bomb, which is closed at both ends and is formed in a pipe filled with solid propellants.

Figure 1:
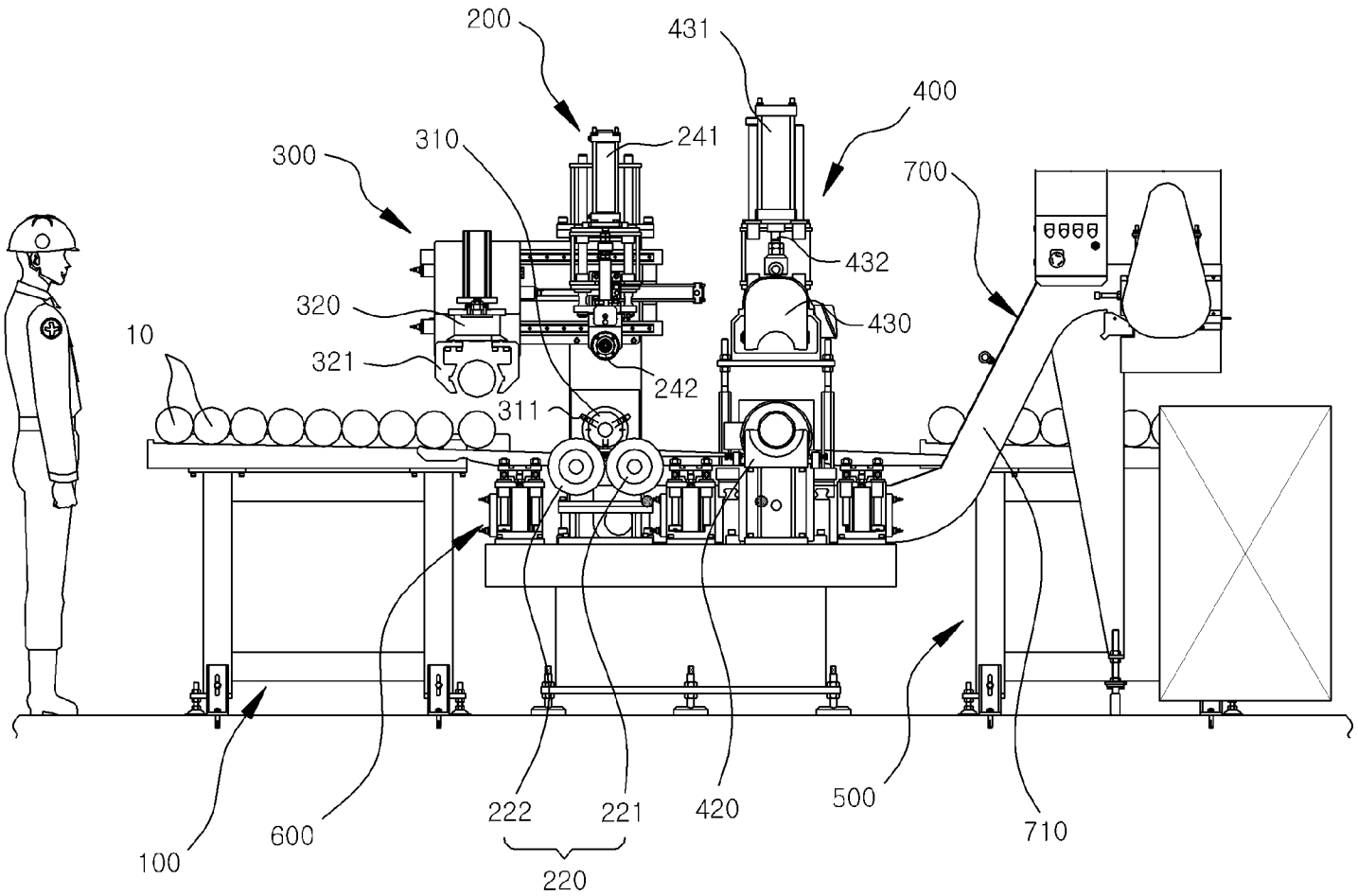
FIG. 1 is a front view of a propellant disposal device for a propulsion system according to a preferred embodiment of the present invention.
Figure 2:
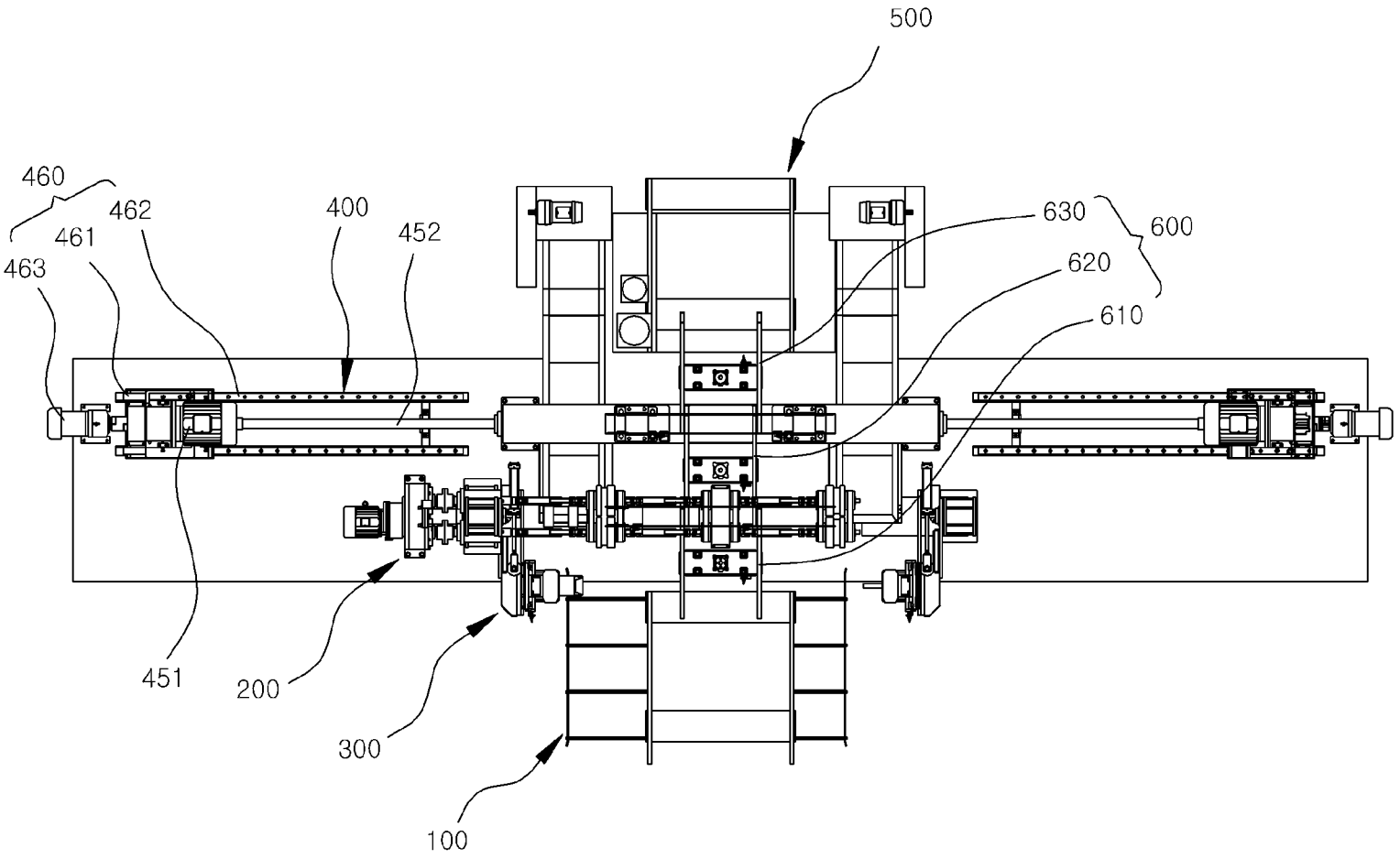
FIG. 2 is a plan view of the propellant disposal device for the propulsion system.
Figure 3:
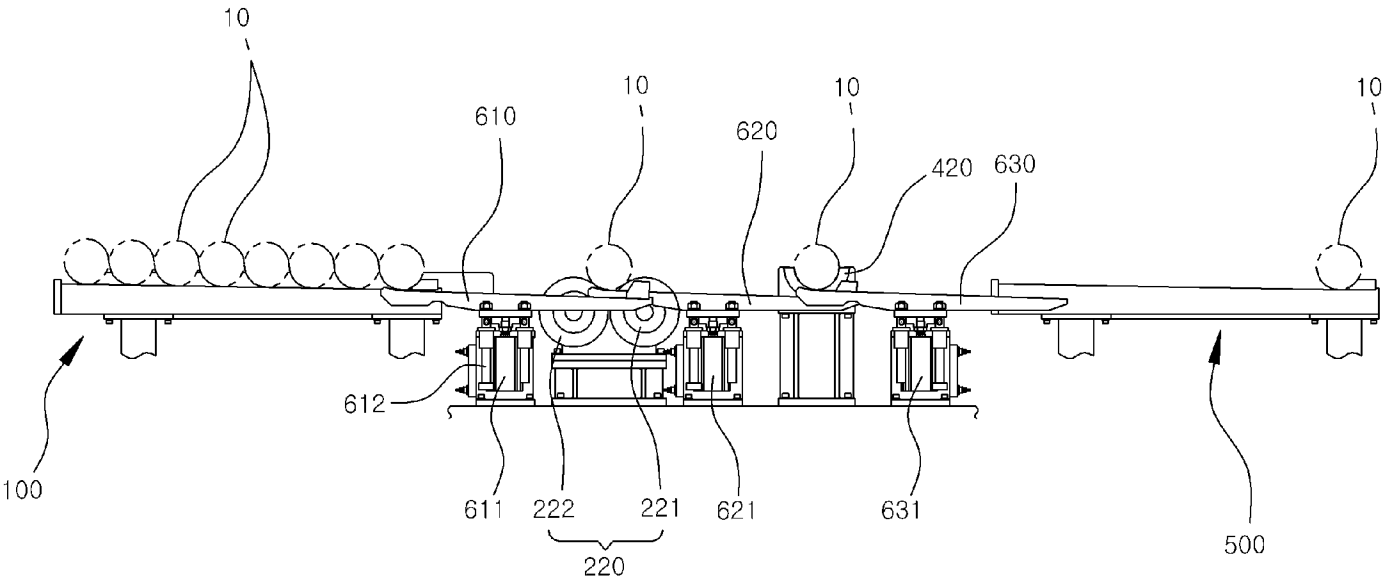
FIG. 3 is a view showing essential parts of the propellant disposal device for the propulsion system for explaining a structure of a delivery unit of the propellant disposal device for the propulsion system.
Figure 4:
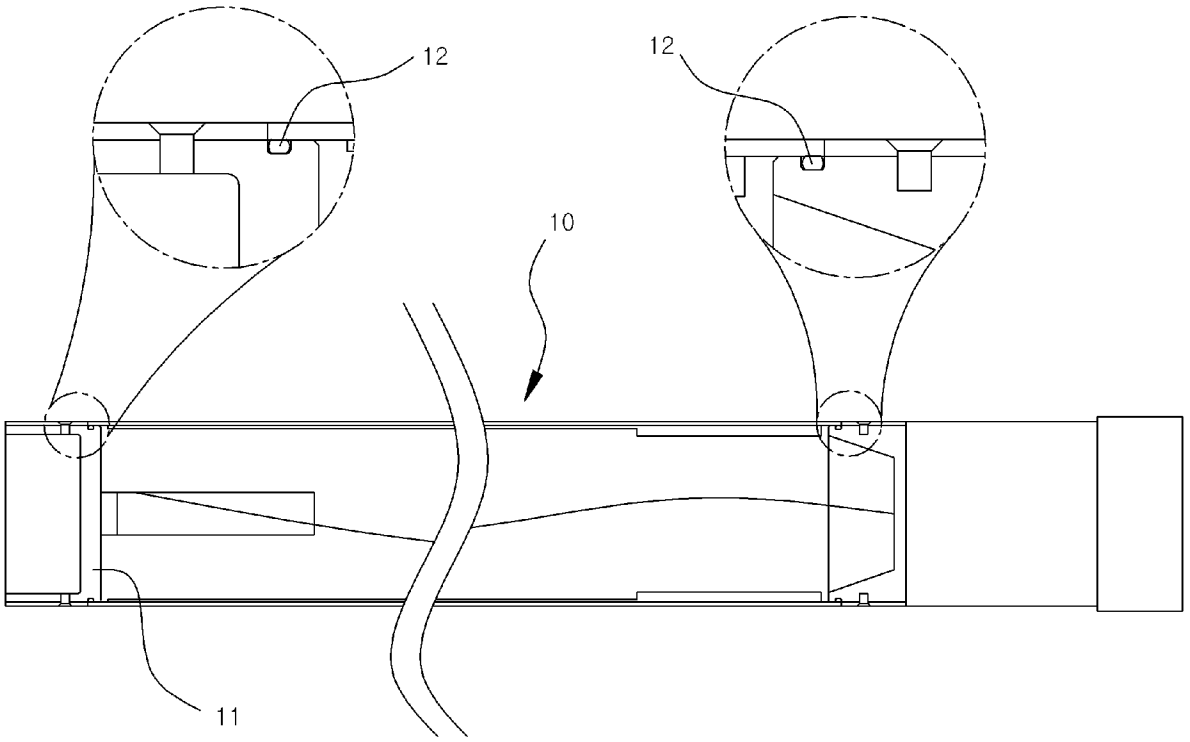
FIG. 4 is a sectional view showing an example of a structure of the propulsion system treated by the propellant disposal device for the propulsion system.

As shown in FIGS. 1 to 3, the propellant disposal device for the propulsion system according to the present invention (hereinafter, called a "disposal device") includes a carry-in unit 100, a cutting unit 200, a separation unit 300, a propellant extraction unit 400, a delivery unit 500, and a return unit 600.

The above parts will be described in more detail as follows.

First, the carry-in unit 100 is a series of parts for temporarily standing by and storing before a target propulsion system 10 is carried into a processing position. In the present invention, the carry-in unit 100 is constructed of a plurality of rollers.

That is, because the carry-in unit 100 has a plurality of the rollers, a plurality of propulsion systems 10 can be arranged and seated in order.

Next, the cutting device 200 is a device for cutting both end portions of the propulsion system 10. The cutting device 200 is arranged for the process subsequent to that of the carry-in unit 100.

As shown in FIGS. 6 to 10, the cutting unit 200 includes a first main frame 210, a seating part 220, a pair of cutters 230, and a movement prevention part 240.

Here, the first main frame 210 includes an upper wall 211 and both side walls 212 and forms the outward appearance of the cutting unit 200. Front and rear sides of the first main frame 210 are opened for allowing the propulsion system 10 to be carried in and delivered out.

Moreover, the seating part 220 is a portion to which the propulsion system 10 is seated and is disposed at a lower part inside the first main frame 210.

The seating part 220 includes a pair of rotary shafts 221, and a plurality of rotational rollers 222 mounted at the rotary shafts 221.

In this instance, the rotary shafts 221 are respectively located at front and rear sides of the bottom of the propulsion system 10 and the propulsion system 10 is seated between the rotary shafts 221. Ends of the rotary shafts 221 are rotatably mounted penetrating a side wall 212 of the first main frame 210.

Furthermore, a roller rotating motor 223 axially joined with the rotary shafts 221 is mounted on the outer face of the side wall, so that the rotary shafts 221 are forcedly rotated by the roller rotating motor 223. So, even though the cutter 230 cuts a part of both ends of the propulsion system 10, because the propulsion system 10 is rotated, the entire circumferential surfaces of both ends of the propulsion system 10 are cut.

Additionally, each of the rotational rollers 222 is constructed to wrap the circumferential surface of each of the rotary shafts 221 and is made of a material with a highly frictional force like rubber.

So, when the rotary shafts 221 are rotated, the rotational rollers 222 are also rotated so that the propulsion system 10 seated on the rotational rollers 222 can be rotated.

In addition, a pair of the cutters 230 has a circular saw for cutting both ends of the propulsion system 10 seated on the seating part 220.

The cutters 230 are elevatably mounted at both upper ends inside the first main frame 210 and receive a driving force from a cutter-driving motor 231.

The cutters 230 are elevated by operation of a cutter-elevating cylinder 232, and the cylinder 232 is fixed on the outer surface of the upper wall 211 of the first main frame 210, and a cylinder rod 233 of the cutter-elevating cylinder 232 penetrates the upper wall 211 and is joined to the cutter-driving motor 231.

Moreover, the cutters 230 are positioned at portions joined with closing caps 11 (See FIG. 4) joined to be inserted into both ends of the propulsion system 10 seated on the seating part 220, particularly, portions where O-rings 12 are mounted. Furthermore, the cutters 230 have a cutting depth set to be as deep as not to completely cut the O-rings 12. The reason is to prevent a damage that may be caused when cutter blades of the cutters 230 get in contact with the closing caps 11 and to smoothly carry out a process of separating the cut ends of the propulsion system 10 cut by the separation unit 300 after completing the cutting work.

Furthermore, the movement prevention part 240 is a series of parts to prevent the propulsion system 10 from being moved laterally during the cutting work of the propulsion system 10.

The movement prevention part 240 is located directly above the seating part 220 inside the first main frame 210.

Additionally, the movement prevention part 240 is elevatably mounted by the roller-elevating cylinder 241, and a contact roller 242 is disposed at an end of a lower side of the movement prevention part 240 and carries out a rolling action while getting in contact with the upper face of the propulsion system 10.

Next, the separation unit 300 separates both ends 13 (hereinafter, called a "cut matters") (See FIG. 10) of the propulsion system 10 cut by the cutting unit 200 and delivers them from the propulsion system 10.

As shown in FIGS. 6 to 10, the separation unit 300 mounted on both side walls 212 of the first main frame 210 of the cutting unit 200 in a horizontally movable manner along a longitudinal direction of the propulsion system 10.

In addition, the separation unit 300 includes: a pair of grasping chucks 310 for grasping the cut matters 13 and separating them from the propulsion system 10; and a pair of delivery clamps 320 elevatably mounted on both side walls 212 of the first main frame 210 in such a way as to be movable back and forth to thereby deliver the cut matters 13 after grasping the cut matters 13 held by the grasping chucks 310.

In this instance, the grasping chucks 310 and the delivery clamps 320 respectively have a plurality of fingers 311 and 321 for grasping outer circumferential surfaces of the cut matters 13 while moving in a peripheral direction by compressed air pressure.

Of course, such a structure of the delivery clamps 320 is not essential. In other words, another structure to deliver the cut matters 13 in free fall by removing the grasping force after a pair of the grasping chucks 310 are moved backwards is also possible. In this case, not shown in the drawings, but it is preferable that a conveyer for returning the cut matters 13 is mounted directly below the side that each of the grasping chucks 310 is moved backwards.

In the meantime, the separation unit 300 is disposed on the cutting unit 200 in the present invention, but if necessary, may be mounted separately from the cutting unit 200.

Next, the propellant extraction unit 400 is a series of parts for extracting the propellants charged within the propulsion system 10 while moving into both ends of the propulsion system 10 opened by the cutting process, and is arranged for the process subsequent to that of the cutting unit 200.

Figure 12:
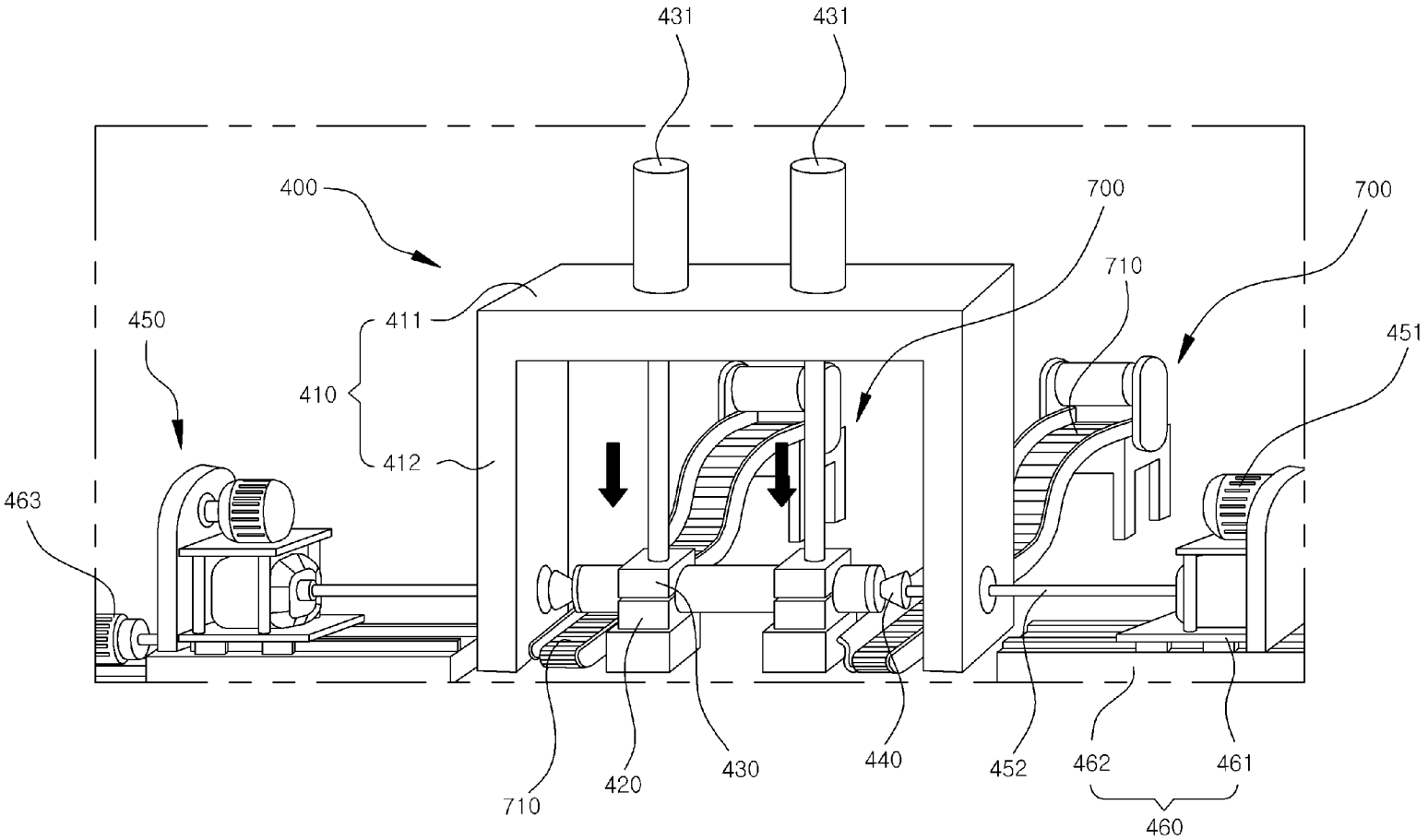
FIGS. 12 to 14 are perspective view showing structures and operation states of a propellant extraction unit and a propellant delivery unit of the propellant disposal device for the propulsion system.
Figure 13:
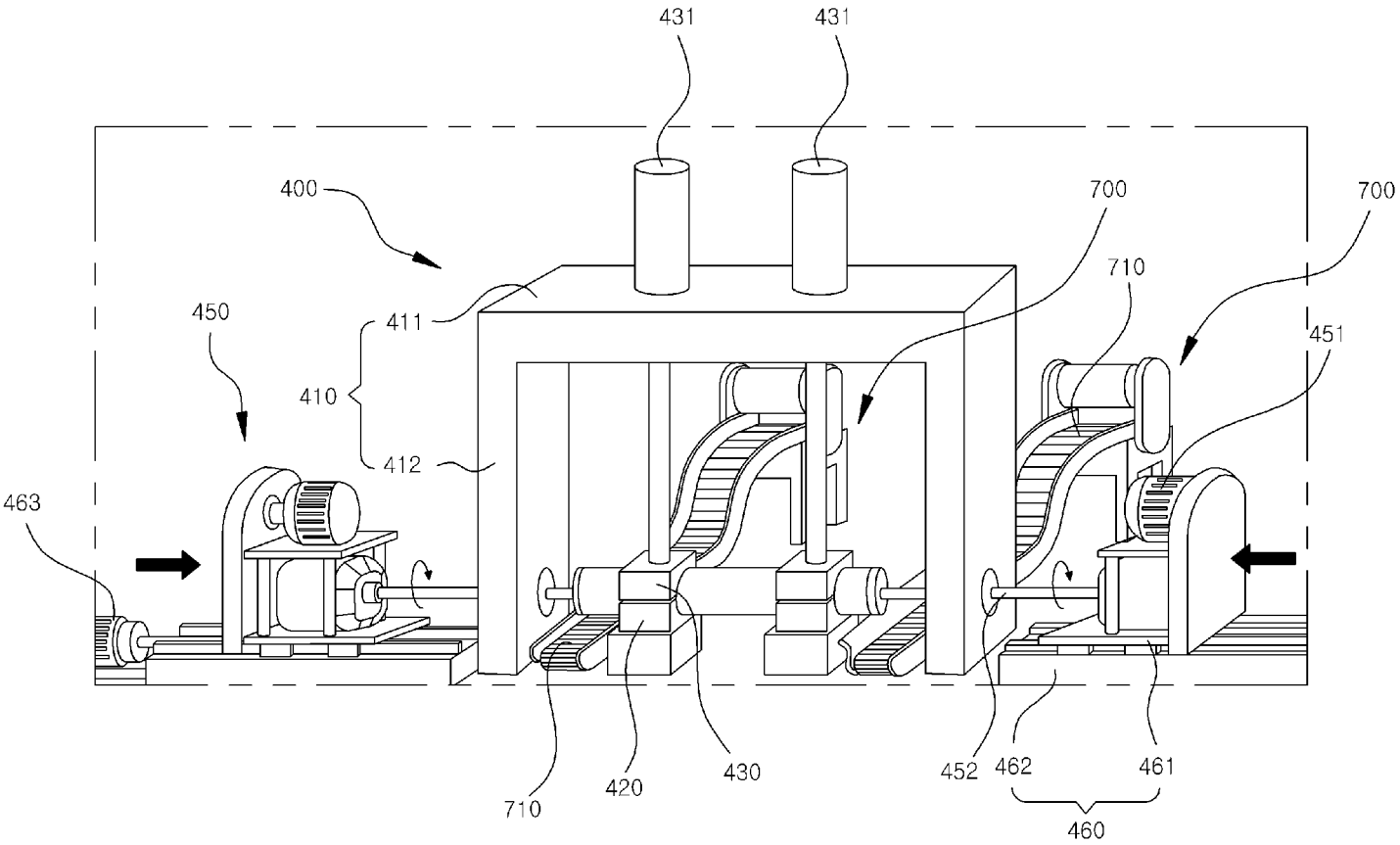
Figure 14:
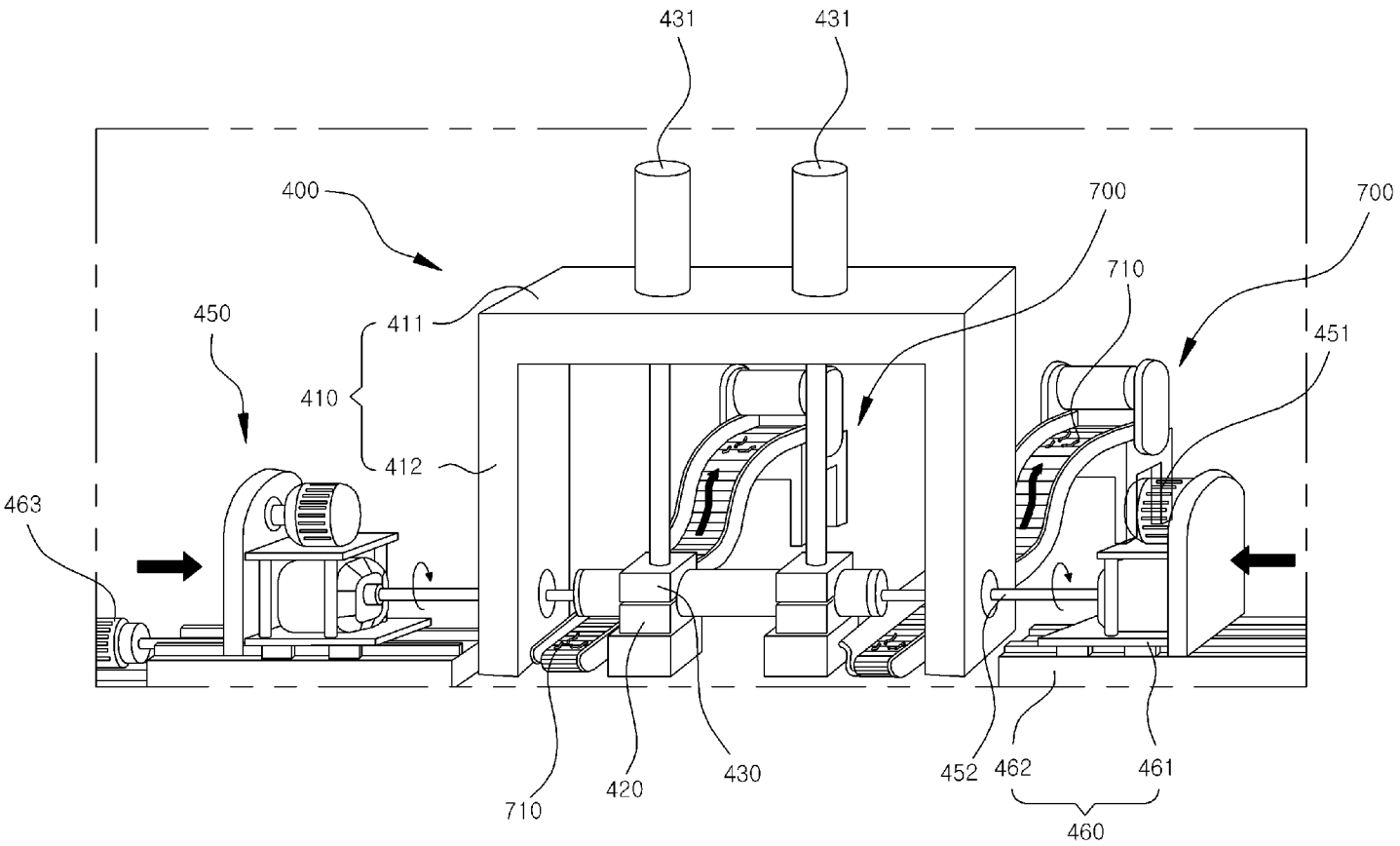

As shown in FIGS. 12 to 14, the propellant extraction unit 400 includes a second main frame 410, a seating base 420, a fixing clamp 430, a tool assembly 440, a driving unit 450, and a moving unit 460.

Here, the second main frame 410 forms the outward appearance of the propellant extraction unit 400 and includes an upper wall 411 and both side walls 412. In this instance, front and rear sides of the second main frame 410 are opened for carrying in and delivering out the propulsion system 10.

Moreover, the seating base 420 is a part on which the propulsion system 10 cut at both ends is seated, is disposed on the bottom inside the second main frame 410, and has a seating recess (not shown) formed on the upper surface in such a fashion that the circumferential surface of the lower end of the propulsion system 10 is seated.

Furthermore, the fixing clamp 430 fixes the propulsion system 10 seated on the seating base 420 together with the seating base 420, and is elevatably mounted on the second main frame 410.

In this instance, the fixing clamp 430 has a seating recess (not shown) formed on the bottom surface of the fixing clamp 430 in such a fashion that the circumferential surface of the upper end of the propulsion system 10.

Additionally, in order to elevate the fixing clamp 430, a cylinder rod 432 of a clamp-elevating cylinder 431 fixed on the outer surface of the upper wall of the second main frame 410 penetrates the upper wall 411 of the second main frame 410 and is connected to the upper surface of the fixing clamp 430.

Moreover, the tool assemblies 440 dig out the propellants charged inside the propulsion system 10 while moving into both ends of the propulsion system 10 seated on the seating base 420.

The tool assemblies 440 are disposed symmetrically at both sides of the seating base 420 and are moved into both ends of the propulsion system 10 seated on the seating base 420.

In this instance, each of the tool assemblies 440 includes a cutting tool, for instance, a drill type end mill, formed in a conical shape whose diameter is gradually reduced toward an end so as to smoothly extract the propellants charged inside the propulsion system 10.

Furthermore, the driving unit 450 has a series of parts for driving the tool assembly 440 and includes a tool driving motor 451, and a driving shaft 452 driven by receiving a driving force of the tool driving motor 451 and joined with the tool assembly 440.

In this instance, the tool driving motor 451 is mounted on the outer face of the side wall 412 of the second main frame 410 in a horizontally movable manner, and the driving shaft 452 penetrates the side wall 412 of the second main frame 410 and is connected with the tool assembly 440.

Particularly, in the present embodiment, it is additionally proposed that the driving shaft 452 is in an empty pipe form and the inside of the tool assembly 440 is opened so that cooling water is supplied to the inside of the driving shaft 452. The reason is to prevent heat generation or flame due to friction which may be generated during work by supplying cooling water to the part where extraction work is carried out while the tool assemblies 440 perform the propellant extraction work.

Furthermore, the moving unit 460 has a series of parts for horizontally moving the driving unit 450, and includes: a seating bracket 461 on which the driving unit 450 is seated; a guide rail 462 for supporting a horizontal movement of the seating bracket 461; and a bracket moving motor 463 connected with the seating bracket 461 and enabling the seating bracket 461 to be moved in support by the guide rail 462.

In this instance, it is preferable that the bracket moving motor 463 and the seating bracket 461 respectively have a ball screw structure and are connected with each other.

Of course, the seating bracket 461 may be moved not by the motor but by an air-oil pressure cylinder.

Next, the delivery unit 500 is to receive and deliver the propulsion system 10 from which the propellants are extracted, and is arranged for the process subsequent to that of the propellant extraction unit 400.

The delivery unit 500 also has a plurality of rollers like the carry-in unit 100, and it is illustrated in FIGS. 1 to 3.

Next, the return unit 600 is to return the propulsion systems 10 to the corresponding process positions in order, and includes components arranged among the above units and parts.

As shown in FIGS. 3, 4, 10 and 14, the return unit 600 includes a first return lever 610 disposed between the carry-in unit 100 and the cutting unit 200, a second return lever 620 disposed between the cutting unit 200 and the propellant extraction unit 400, a third return lever 630 disposed between the propellant extraction unit 400 and the delivery unit 500, and first, second and third elevation cylinders 611, 621 and 631 for respectively elevating the return levers 610, 620 and 630.

In this instance, the first return lever 610 has an end located at the bottom of the side of the carry-in unit 100 where the propulsion system 10 is delivered and the other end located at the bottom (the bottom of each rotary shaft forming the seating part) of the side of the cutting unit 200 where the propulsion system 10 is seated, and is gradually downwardly inclined from one end toward the other end.

Additionally, the second return lever 620 has an end located at the bottom (the bottom of each rotary shaft forming the seating part) of the side of the cutting unit 200 where the propulsion system 10 is seated and the other end located at the bottom of the side of the propellant extraction unit 400 where the propulsion system 10 is seated, and is gradually downwardly inclined from one end toward the other end.

Moreover, the third return lever 630 has an end located at the bottom of the side of the propellant extraction unit 400 where the propulsion system 10 is seated and the other end located at the bottom of the side of the delivery unit 500 where the propulsion system 10 is carried in, and is gradually downwardly inclined from one end toward the other end.

Furthermore, each of the elevation cylinders 611, 621 and 631 is located at the bottom of each of the return levers 610, 620 and 630, and cylinder rods 612, 622 and 632 of the elevation cylinders 611, 621 and 631 are respectively joined and fixed to bottoms of the return levers 610, 620 and 630.

Particularly, in the present invention, the return levers 610, 620 and 630 are arranged in such a way as to be intercrossed along a direction perpendicular to a return direction of the propulsion system 10 so that they do not interfere with one another in operation.

Of course, not shown in the drawings, but the return levers 610, 620 and 630 may be formed in such a way as to be all horizontal to one another and to be inclined when the elevation cylinders 611, 621 and 631 are elevated.

Meanwhile, in the present invention, the propellant disposal device may further include a propellant delivery unit 700 for delivering the propellants extracted by the propellant extraction unit 400 to a set place.

As shown in FIGS. 12 to 14, the propellant delivery unit 700 has an end located at the bottom of a portion of the propellant extraction unit 400 where both ends of the propulsion system 10 are located, and includes a conveyer 710 inclined upwardly and formed at a portion of an area ranging from the end which receives the propellants to the other end which delivers the propellants. Of course, it is preferable that the propellant delivery unit 700 further includes a hopper (not shown) formed at the propellant delivering side of the conveyer 710 for containing the propellants.

Hereinafter, the action of the propellant disposal device according to the present invention will be described in order of the processes in more detail.

Figure 5:
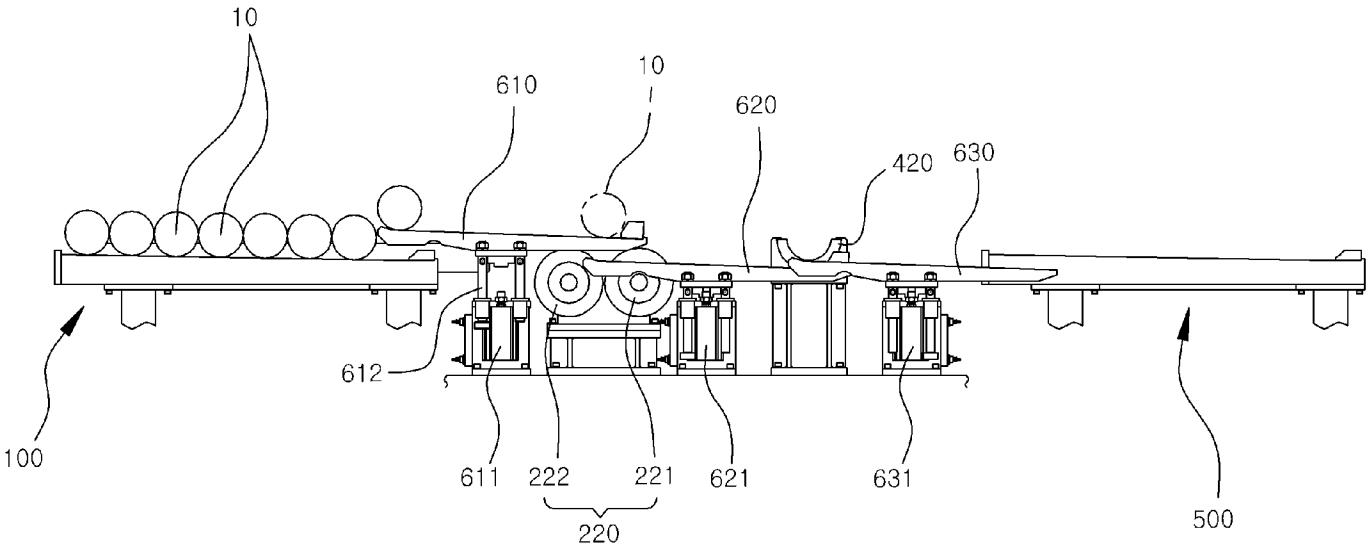
FIG. 5 is a view showing essential parts for explaining an operation state of a first return lever of the delivery unit of the propellant disposal device for the propulsion system.

First, as shown in FIG. 3, when work is started while the propulsion systems 10 respectively seated on the carry-in unit 100 are on standby, as shown in FIG. 5, the first elevation cylinder 611 of the return unit 600 is operated so as to upwardly move the first return lever 610.

Figure 6:
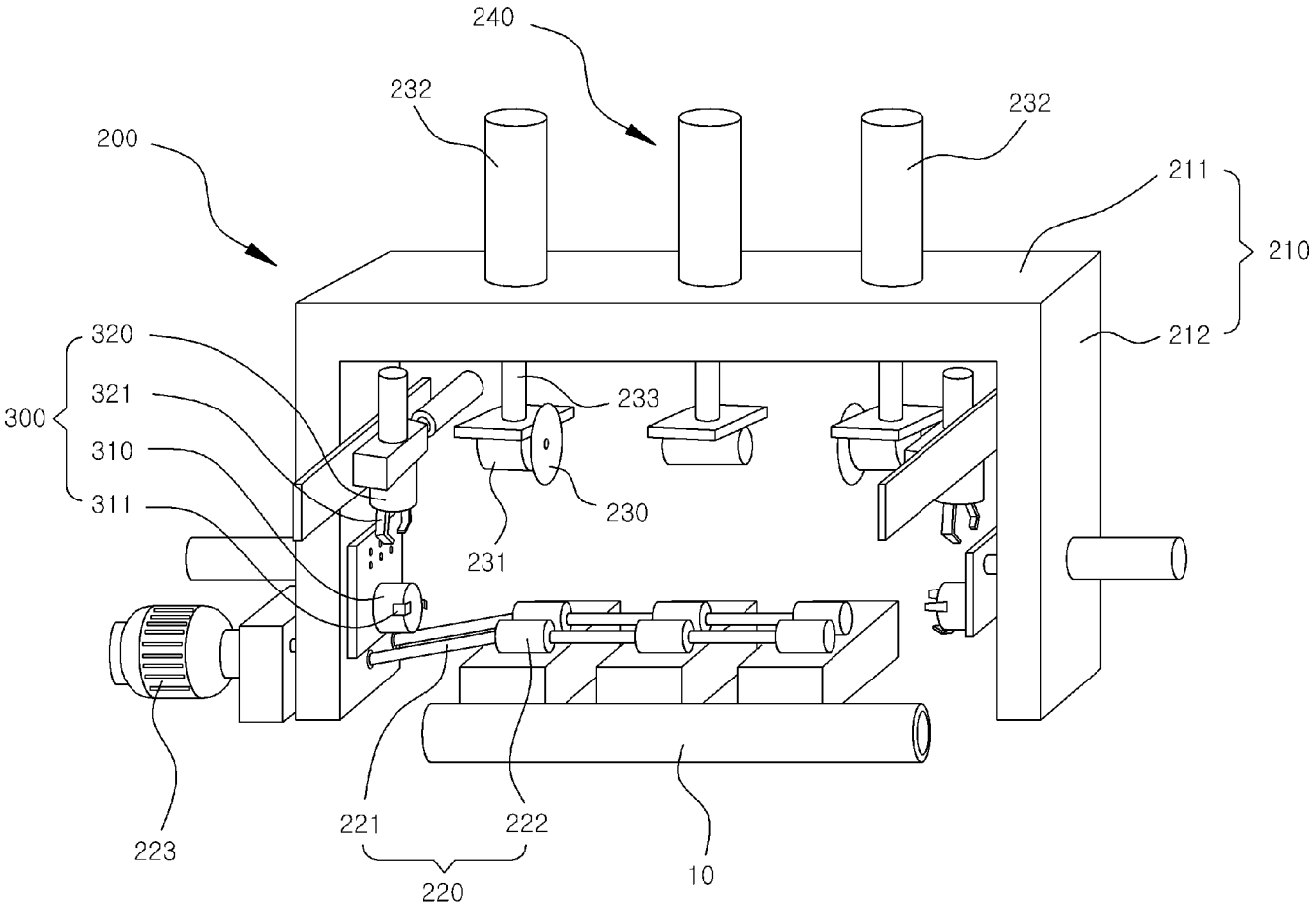
FIGS. 6 to 10 are perspective views showing structures and operation states of a cutting unit and a separation unit of the propellant disposal device for the propulsion system.

Accordingly, each the propulsion systems 10 is upwardly moved in a state where they are seated on the first return lever 610, and in this instance, the propulsion system 10 is located between the two rotary shafts 221 of the seating part 220 of the cutting unit 200, which is located at the post process position, while rolling by an inclination angle formed by the first return lever 610, and then, is seated on the rotational rollers 222 mounted on the rotary shafts 221. The above is illustrated in FIGS. 6 and 7.

Figure 7:
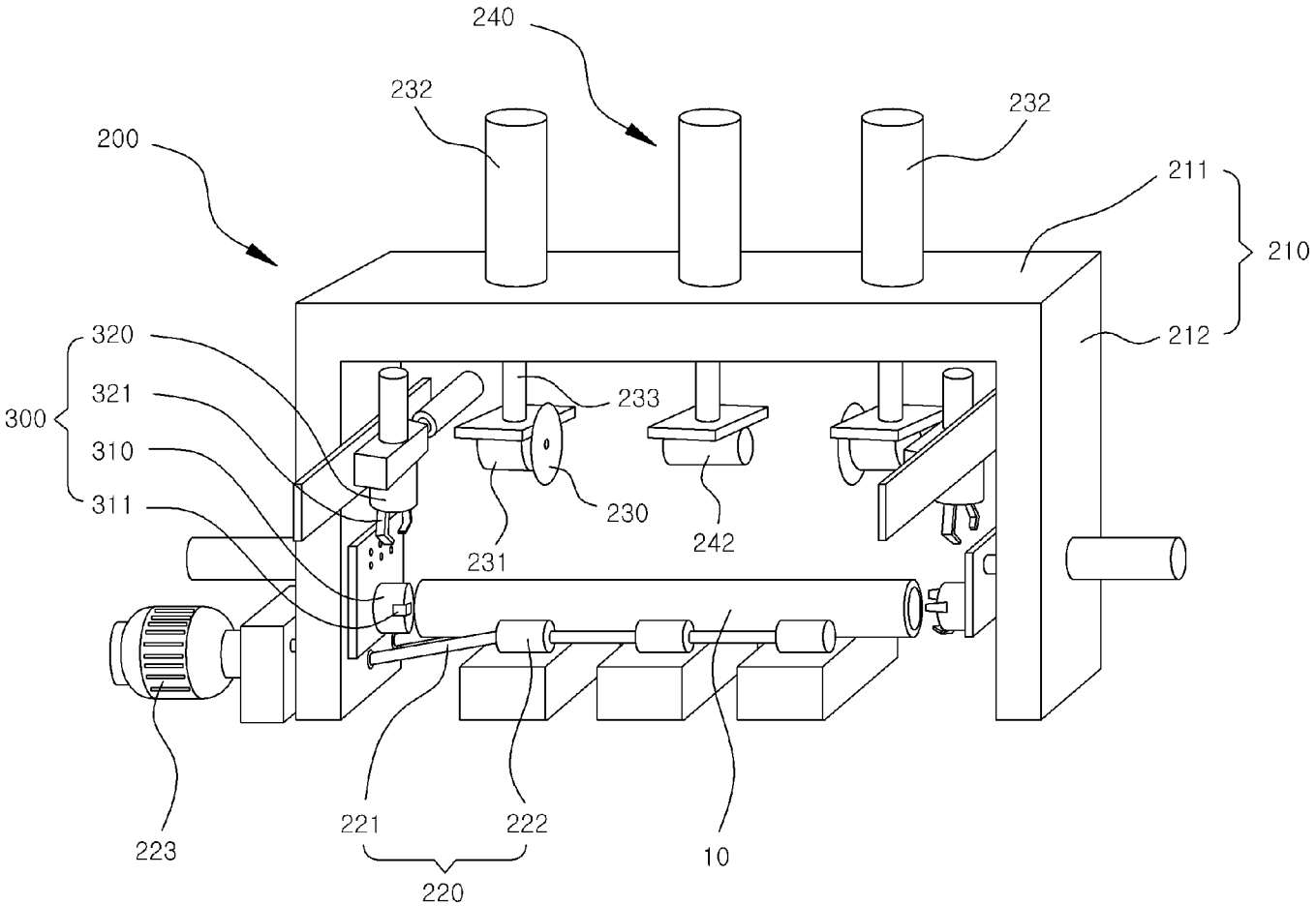

Next, as shown in FIG. 7, when the propulsion system 10 is seated between the two rotary shafts 221, cutting work for cutting both ends of the seated propulsion systems 10 is carried out.

Figure 8:
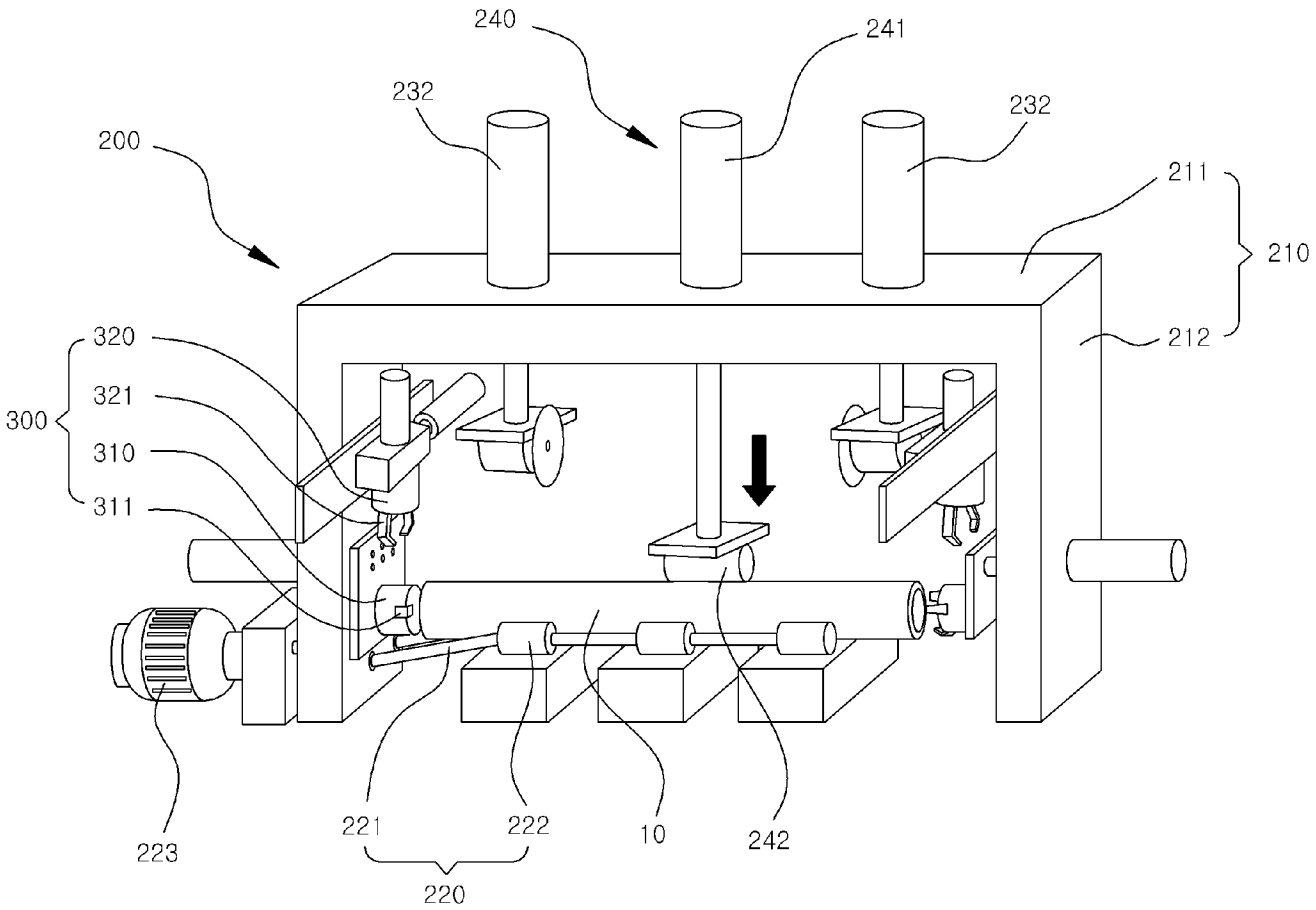
Figure 9:
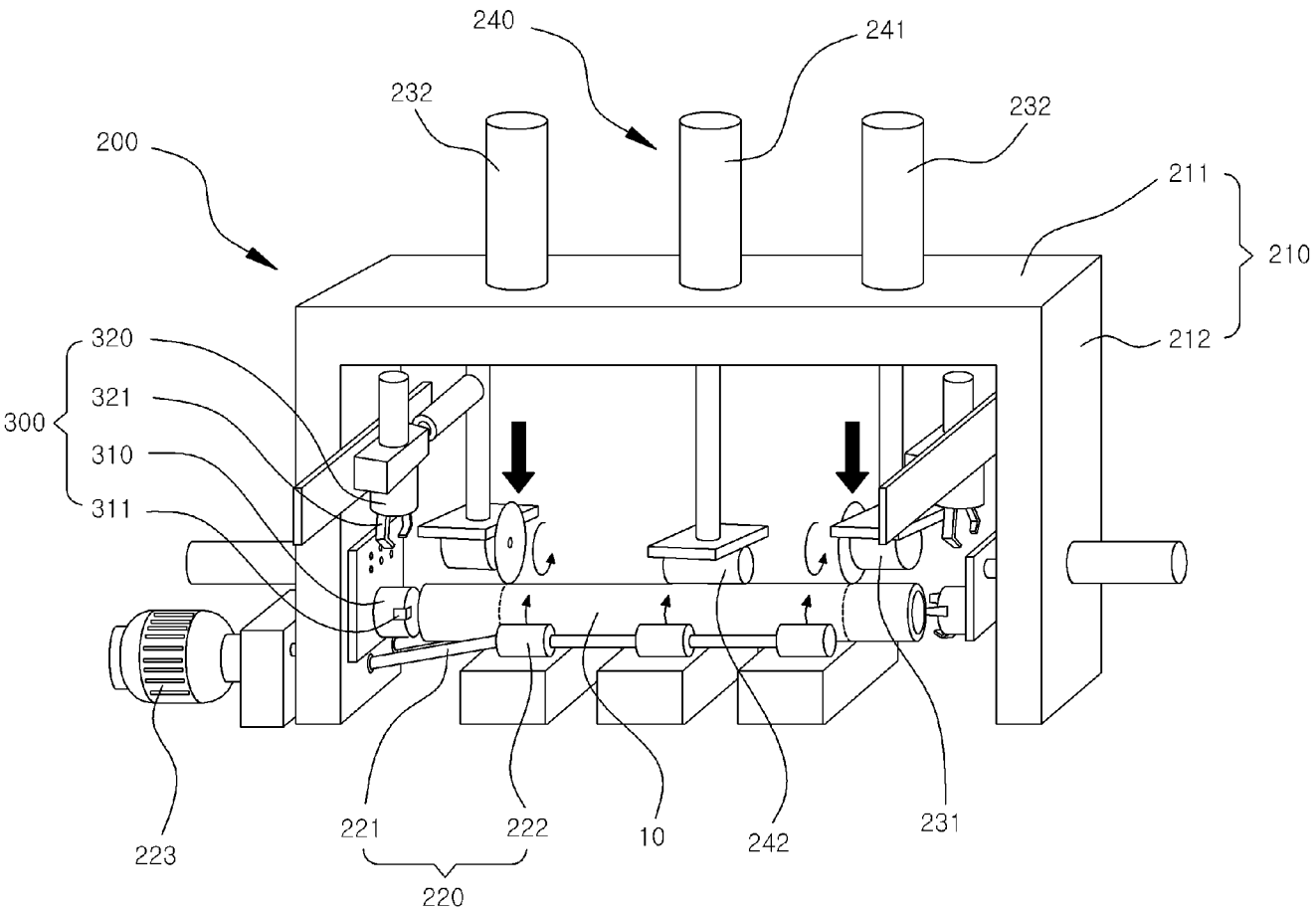

In this instance, as shown in FIG. 8, the contact roller 242 of the movement prevention part 240 gets in contact with the upper surface of the propulsion system 10 while moving downwardly, and in this state, as shown in FIG. 9, a pair of the cutters 230 are moved downwardly and rotated by the driving force of the cutter driving motor 231 so as to cut set portions of both ends of the propulsion system 10. In this instance, the set portion means an O-ring mounted portion of a part joined with the closing cap 11 that is joined to be inserted into both ends of the propulsion system 10.

Furthermore, as described above, when the cutting work of both ends of the propulsion system 10 by the cutters 230 is carried out, the roller rotating motor 223 is operated so as to rotate the rotary shafts 221. Accordingly, because the propulsion system 10 is rotated while the rotational rollers 222 also perform a rolling motion by the rotation of the rotary shafts 221, the cutting work can be performed more smoothly. In this instance, a rotational direction of the propulsion system 10 is controlled to be opposed to the rotational direction of the cutters 230.

Additionally, when the cutting work of both ends of the propulsion system 10 is finished through a series of the above processes, the cutters 230 and the contact roller 242 are elevated to their initial positions and the operation of the cutters 230 is stopped, and then, the rotation of the rotary shafts 221 is also stopped while the operation of the roller rotating motor 223 is stopped.

In this instance, because both ends of the propulsion system 10 are not completely cut but just the surface of the propulsion system 10 is cut, in fact, they keep a state where they are attached to the propulsion system 10 by a part of the O-ring 12, which is not completely cut, and the closing cap 11 which is located crossing the inside part and the outside part of the propulsion system 10 along boundary with the cut portion.

Next, when the cutting work of both ends of the propulsion system is completed, both ends (cut matters) of the propulsion system 10 cut by the separation unit 300 are separated from the propulsion system 10 and delivered to the set position.

Figure 10:
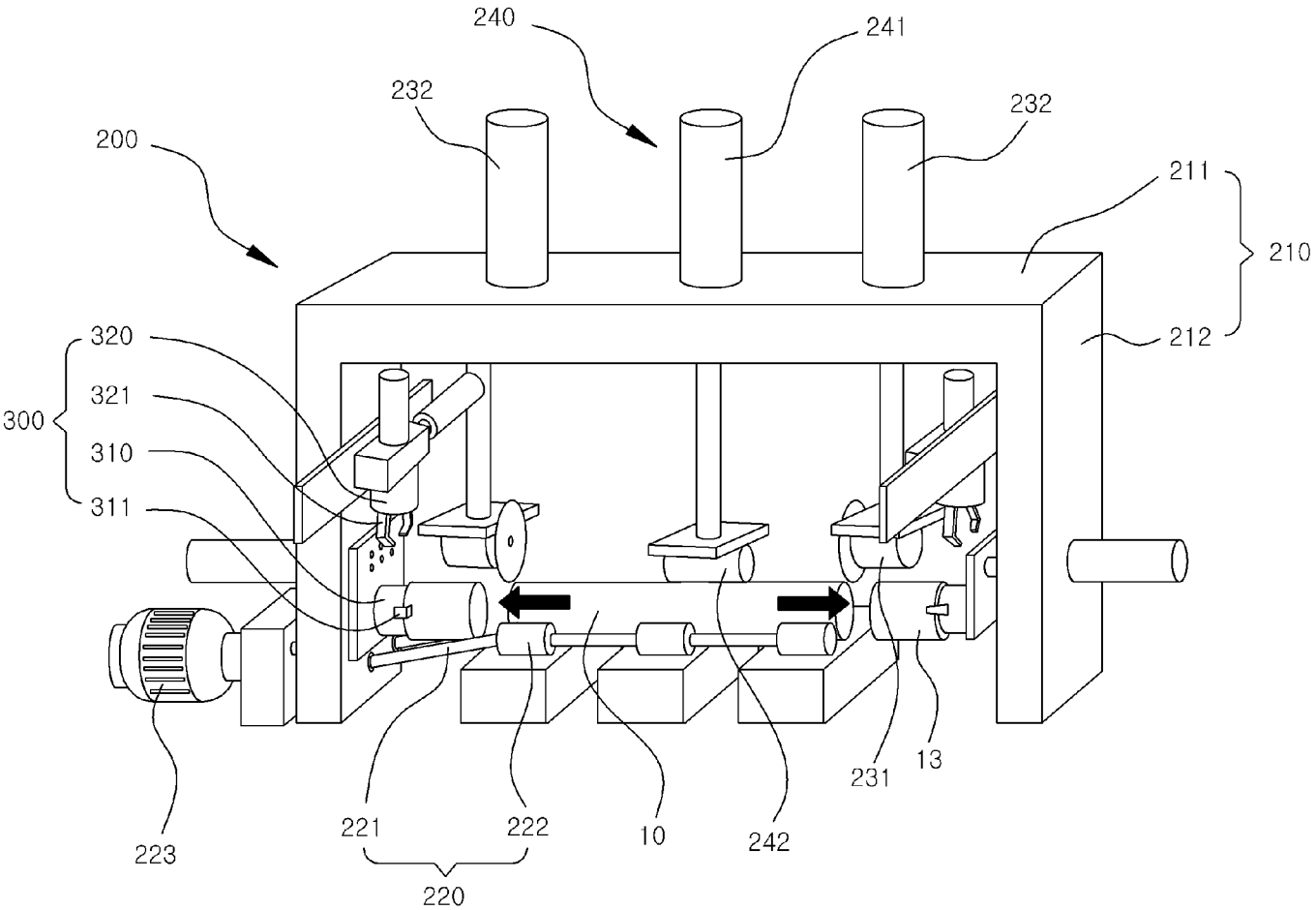

As shown in FIG. 10, when a pair of the grasping chucks 310 of the separation unit 300 are moved backwardly in a state where they respectively grasp the cut matters 13, some of both ends of the propulsion system 10 and the closing cap 11 are forcedly separated from the propulsion system 10. Continuously, when the delivery clamp 320 releases the grasping force after moving forwardly in a state where the delivery clamp 320 grasps the cut matters 13, the cut matters 13 are delivered out in free fall to the corresponding position.

Next, when the cutting work of both ends of the propulsion system is completed through the above process, the propulsion system 10 is transferred to the propellant extraction unit 400 located at the post process position, and then, work for extracting the propellants charged inside the propulsion system 10 is carried out.

For this, the second elevation cylinder 621 of the return unit 600 is operated so as to upwardly move the second return lever 620.

Figure 11:
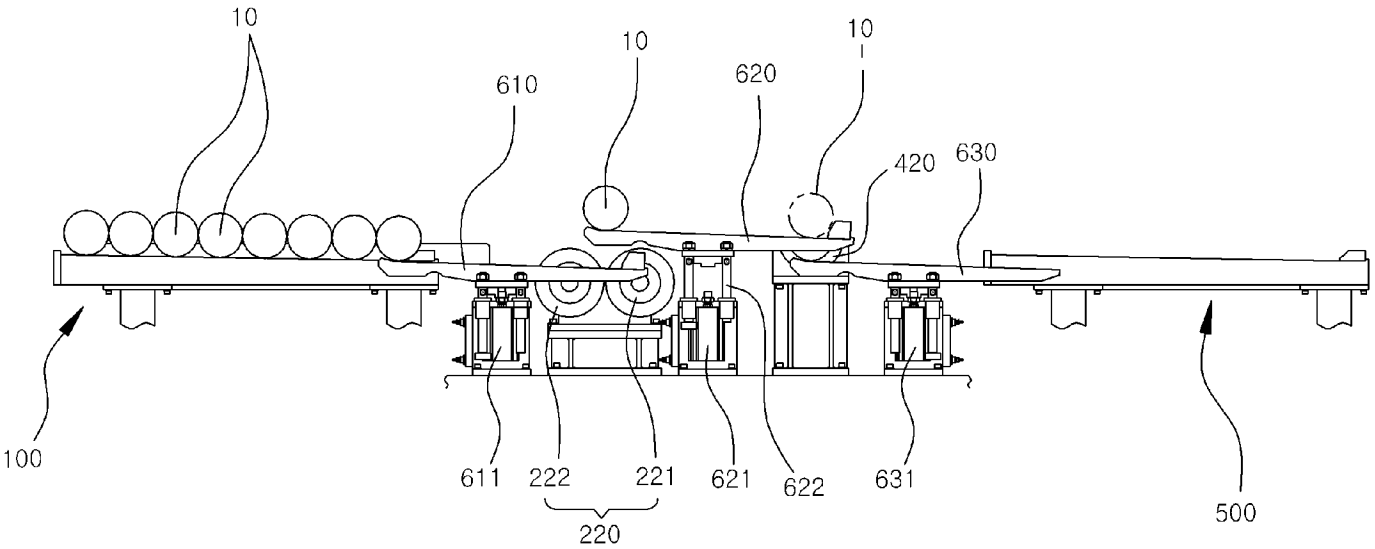
FIG. 11 is a view showing essential parts for explaining an operation state of a second return lever of the delivery unit of the propellant disposal device for the propulsion system.

Accordingly, the propulsion system 10 is upwardly moved in a state where it is seated on the upper surface of the second return lever 620. During the upward movement, the propulsion system 10 is seated on the seating base 420 of the propellant extraction unit 400, which is located at the post process position, while rolling by the inclination angle formed by the second return lever 620. It is illustrated in FIG. 11.

In addition, when the propulsion system 10 is completely seated on the seating base 420, as shown in FIG. 12, a pair of the fixing clamps 430 are moved downwardly so as to fix both ends of the propulsion system 10 seated on the seating base 420.

In the above state, as shown in FIG. 13, when the tool driving motor 451 of the driving unit 450 is operated, the tool assemblies 440 are rotated, the bracket moving motor 463 of the moving unit 460 is also operated, and the driving unit 450 is gradually moved toward the propulsion system 10, so that the propellants charged inside the propulsion system 10 are extracted.

In this instance, when a pair of the tool assemblies 440 reach a position where they abut to each other, one of the tool assemblies 440 moves backwards and the other one continuously moves forwards, so that the propellants inside the propulsion system 10 can be completely extracted.

In this instance, cooling water is supplied through the driving shafts 452 of the driving unit 450, and the supplied cooling water is provided to the tool assemblies, so that a worker can carry out work in safety because flame or heat generation is prevented while the tool assemblies 440 extract the propellants.

Furthermore, while the propellants are extracted, the conveyer 710 of the propellant delivery unit 700 is operated to receive the propellants falling from both ends of the propulsion system 10 and stores them in the hopper (not shown). It is illustrated in FIG. 14.

Finally, when the propellants inside the propulsion system 10 are all extracted through the above processes, the operation of the tool assemblies 400 is stopped after a pair of the tool assemblies 400 get out of and are separated from the propulsion system 10 by the operation of the moving unit 460, and then, a pair of the fixing clamps 430 remove restriction to the propulsion system 10 while moving upwardly.

Figure 15:
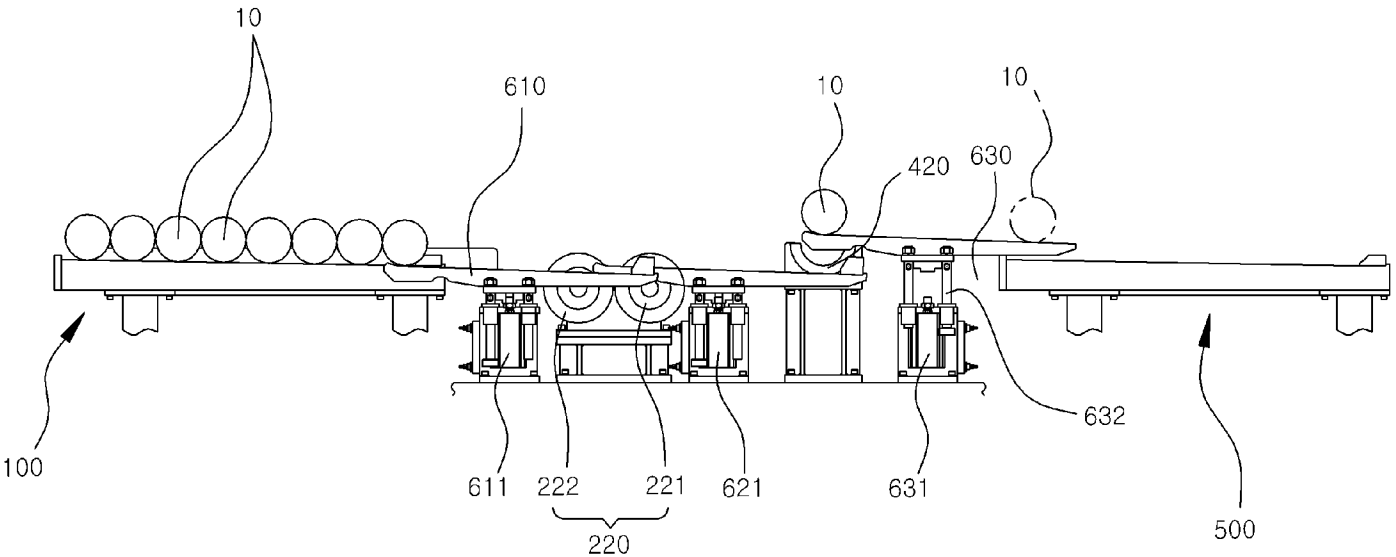
FIG. 15 is a view showing essential parts for explaining an operation state of a third return lever of the delivery unit of the propellant disposal device for the propulsion system.

After that, as shown in FIG. 15, when the third elevation cylinder 631 of the return unit 600 is operated to upwardly move the third return lever 630, the propulsion system 10 is moved upwardly in a state where it is seated on the upper surface of the third return lever 630, and then, the propulsion system 10 is delivered to the delivery unit 500, which is located at the post process position, while rolling by the inclination angle formed by the third return lever 630, so that treatment of the corresponding propulsion system 10 is completed.

In the meantime, as described above, the propellant disposal process of the propulsion system 10 is controlled to be consecutively and repeatedly performed, so that a plurality of the propulsion systems 10 can be consecutively treated.

Finally, the propellant disposal device for the propulsion system according to the present invention enables the propulsion systems and propellants to be reutilized and makes the disposal process safe.

Moreover, the propellant disposal device for the propulsion system according to the present invention is not restricted to the above described embodiment and structure.

For instance, the carry-in unit 100 and the delivery unit 500 may be units, like robot arms, for individually carrying in and delivering the propulsion systems 10 to their processing positions.

Furthermore, the first main frame 210 of the cutting unit 200 and the second main frame 410 of the propellant extraction unit 400 may be formed separately from each other, but may be formed monolithically to thereby minimize the entire size of the disposal device and simplify the structure of the disposal device.

What is claimed is:

1. A propellant disposal device for a propulsion system comprising:

a carry-in unit configured to supply propulsion systems;

a cutting unit arranged for a process subsequent to that of the carry-in unit, and configured to individually receive the propulsion systems that are on standby at the carry-in unit and cut two opposite ends of the received propulsion system;

a propellant extraction unit arranged for a process subsequent to that of the cutting unit, and configured to insert an extraction tool into the cut ends of the propulsion system and extract the propellants charged within the propulsion system;

a return unit configured to sequentially deliver the propulsion system to the corresponding process positions; and a propellant delivery unit having its end portion located below the cut end of the propulsion system where the extraction tool is inserted, and configured to deliver the extracted propellants to a preset location for discharge.

2. The propellant disposal device according to claim 1, wherein the cutting unit comprises:

a main frame forming an outward appearance of the cutting unit and having an upper wall and two side walls;

a seating part disposed below the main frame for seating the propulsion system received from the carry-in unit;

a pair of cutters reciprocally mounted on the main frame and driven by a driving force of a motor for cutting the opposite ends of the propulsion system seated on the seating part; and a movement prevention part disposed directly above the seating part, the movement prevention part configured to be in contact with an upper surface of the propulsion system seated on the seating part to prevent movement of the propulsion system when the two opposite ends of the propulsion system are cut by the cutting unit.

3. The propellant disposal device according to claim 2, wherein the seating part comprises:

a pair of rotary shafts configured to rotate by a driving force of a motor for rotation; and rotational rollers coupled to the rotary shafts, and configured to have the propulsion system seated thereon and rotate the propulsion system in response to the rotation of the rotary shafts.

4. The propellant disposal device according to claim 2, wherein the movement prevention part is mounted in such a way as to be elevated by an elevation cylinder of the main frame and comprises a contact roller disposed at an end of a lower portion thereof in such a way as to perform a rolling action in contact with the upper surface of the propulsion system.

5. The propellant disposal device according to claim 2, further comprising a separation unit, wherein the separation unit comprises:

a pair of grasping chucks disposed adjacent the side walls of the main frame of the cutting unit in a horizontally movable manner along a longitudinal direction of the propulsion system; and delivery clamps disposed adjacent the side walls of the main frame of the cutting unit in such a way as to be movable back and forth, to thereby grasp and deliver the cut ends of the propulsion system grasped by the grasping chucks.

6. The propellant disposal device according to claim 1, wherein the propellant extraction unit comprises:

a main frame forming an outward appearance of the propellant extraction unit and having an upper wall and two side walls;

a seating base disposed below the main frame and having a seating recess formed on an upper surface thereof for seating the the propulsion system with the opposite ends cut by the cutting unit;

a fixing clamp reciprocally mounted on the main frame for preventing rotation of the propulsion system by pressurizing the circumferential surface of the propulsion system seated on the seating base;

tool assemblies located at both sides of the seating base and adapted to extract propellants charged within the propulsion system while moving into the cut ends of the propulsion system seated on the seating base;

a driving unit adapted for driving the tool assemblies; and a moving unit adapted for horizontally moving the driving unit.

7. The propellant disposal device according to claim 6, wherein each of the tool assemblies has the extraction tool formed in a conical shape whose diameter is gradually reduced toward a terminal end thereof.

8. The propellant disposal device according to claim 6, wherein the driving unit comprises a driving motor and a driving shaft joined with the tool assembly while being driven by the driving force of the driving motor, wherein the driving shaft has an empty pipe form so that cooling water is supplied to the inside of the driving shaft.

9. The propellant disposal device according to claim 1, wherein the return unit comprises:

a first return lever having a first end located at an inner area of the carry-in unit where the propulsion system is provided and a second end located at an inner area of the cutting unit where the propulsion system is seated, the first return lever being gradually downwardly inclined from the first end toward the second end;

a second return lever having a first end located at an inner area of the cutting unit where the propulsion system is seated and a second end located at an inner area of the propellant extraction unit where the propulsion system is seated, the second return lever being gradually downwardly inclined from the first end toward the second end;

a third return lever having a first end located at an inner area of the propellant extraction unit where the propulsion system is seated and a second end located toward a delivery place of the propulsion system, the third return lever being gradually downwardly inclined from the first end toward the second end; and elevation cylinders for selectively elevating the return levers, wherein the return levers are arranged in a manner such that said return levers do not interfere with one another in operation.

10. The propellant disposal device according to claim 1, wherein the propellant delivery unit comprises:

a conveyer configured to take the propellants dropped from the cut ends of the propulsion system to the preset location for discharge; and a hopper disposed adjacent the conveyer for gathering the propellants therein.

11. The propellant disposal device according to claim 10, wherein the conveyer has a shape inclined gradually upwardly from a starting portion to an end portion thereof.

* * * * *